United States Patent [19]

Nunlist

[11] 4,137,669

[45] Feb. 6, 1979

[54] BALANCING MECHANISM FOR MANHOLE COVERS

[75] Inventor: Erwin J. Nunlist, Penfield, N.Y.

[73] Assignee: Sybron Corporation, Rochester, N.Y.

[21] Appl. No.: 876,082

[22] Filed: Feb. 8, 1978

[51] Int. Cl.[2] ..... E05F 1/10

[52] U.S. Cl. ..... 49/386; 49/402

[58] Field of Search ..... 49/386, 402, 379

[56] References Cited

U.S. PATENT DOCUMENTS

| | | | |
|---|---|---|---|
| 1,989,908 | 2/1935 | Bohnsack et al. | 49/386 X |
| 2,357,044 | 8/1944 | Wagner | 49/386 |
| 3,615,134 | 10/1971 | Newcomb | 49/386 X |
| 3,665,958 | 5/1972 | Dunkelis | 49/386 X |
| 3,714,680 | 2/1973 | Little | 49/386 X |

*Primary Examiner*—Philip C. Kannan

*Attorney, Agent, or Firm*—Theodore B. Roessel; James A. Rich; Papan Devnani

[57] ABSTRACT

A balancing mechanism for manhole covers uses two sets of conical disc springs, one stronger than the other, mounted on a common pull rod, to balance the cover as it moves from the open vertical position to the closed position. This provides a progressive spring force curve that balances the manhole in any position between the closed position and the vertical position. The balancing mechanism is also provided with an additional set of disc springs that absorb shock when the cover is opened rapidly. The mechanism is preferably mounted on a nozzle protection ring, which allows the system to be installed on existing glass lined vessels without welding, drilling or similar operations which might damage the lining.

7 Claims, 2 Drawing Figures

BALANCING MECHANISM FOR MANHOLE COVERS

BACKGROUND OF THE INVENTION

This invention relates to a spring balance mechanism for manhole covers. Most manhole covers on tanks, vessels and other processing equipment are hinged. Manhole covers have often caused injury to operators and damage to the assembly by falling back on the manhole collar, particularly the ones on glass lined vessels. Manhole covers on pressure vessels are usually very heavy and hard to operate, especially for women, who are being employed in considerably larger numbers in the processing and heavy industries. By use of spring balance devices for manhole covers, a manhole cover can be opened and closed more easily and safely than a manhole cover without balance assistance, and the possibility of injury from falling covers is virtually eliminated.

One such system, shown in German Gebrauchsmuster No. 7,402,411, uses a set of conical disc springs which are compressed as the cover closes. This system is more desirable than ones with helical springs because it is more compact. However, the system also has certain disadvantages.

The system described in the reference has a regressive or diminishing spring force curve. In other words, the incremental change in the force exerted, for the corresponding incremental compression of the springs, decreases as the springs are compressed. For the geometry of most manhole cover mechanisms, the spring force curve should be progressive, not regressive, to more nearly match the force required to balance the manhole in any position. However, almost all commercially available disc springs have a regressive spring force characteristic.

Another disadvantage of the system shown in the reference is that there is no provision to absorb shocks which can occur if the cover is opened rapidly, which is not unlikely with a balancing system that allows the cover to be moved easily. Hinged mounting systems such as the one shown in the reference typically include stops to limit the opening movement of the cover. If the cover is swung rapidly to the point where stops limit the movement, the shock of the sudden deceleration of the cover movement must be absorbed by the mounting system. High stresses can be created in this situation.

Yet another disadvantage of the system shown in the reference is that it must be attached to the vessel itself by drilling or welding, which makes it difficult to install on existing glass lined vessels because of the dangers of damaging the glass lining, and the dangers of explosion created by working on vessels in hazardous environments.

SUMMARY OF THE INVENTION

One object of this invention is to provide a spring balancing mechanism for manhole covers with a progressive spring force characteristic that more closely matches the force required to balance certain covers. This is accomplished by using at least two subsets of disc springs, with one set being stronger than the other. As the cover starts to close, the weaker set is compressed more rapidly, and the spring force characteristic increases after the weaker set is fully compressed. Thus, the overall spring force characteristic curve is progressive, despite the fact that the individual subsets of springs have regressive spring force characteristics.

Another object of this invention is to provide a spring balancing system that reduces the shock or sudden stresses produced when the cover is slammed against the backstops. This is accomplished by using another compressible member, preferably additional disc springs, which are compressed as the cover moves to a fully opened position defined by a set of stops.

Yet another object of the invention is to provide a mounting system and balancing aid for manhole covers that can be installed on existing glass lined vessels without welding, drilling or similar operations on the vessel that might damage it. This is accomplished by attaching the balancing system to a manhole protection ring of the type frequently used to protect nozzles on glass lined reactors from mechanical damage. The shock adsorption system described above helps make this type of installation possible by reducing the stresses that can be imposed on the protection ring by opening the cover rapidly.

DETAILED DESCRIPTION

Figure 1:
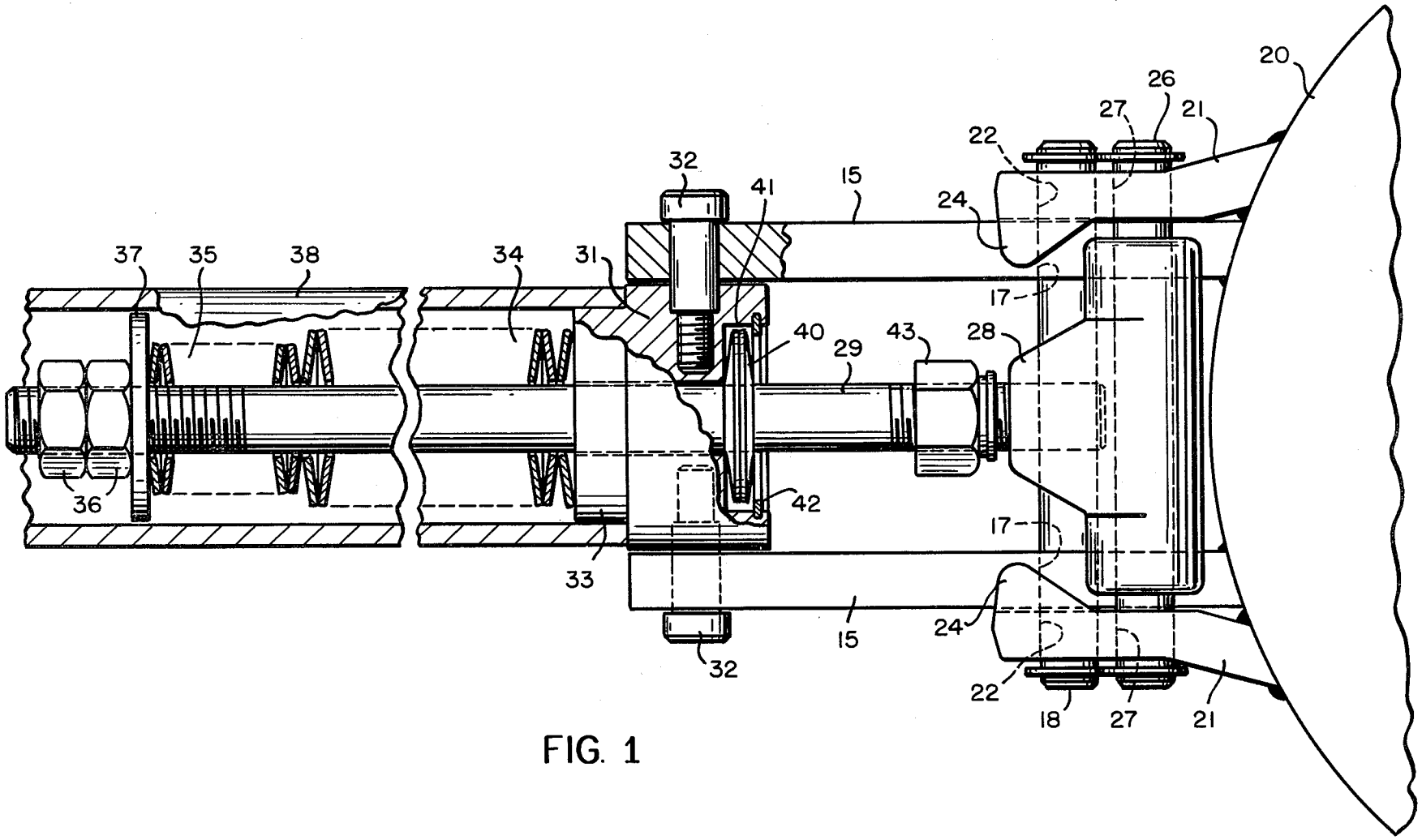
FIG. 1 is a partially sectioned view of balancing mechanism.
Figure 2:
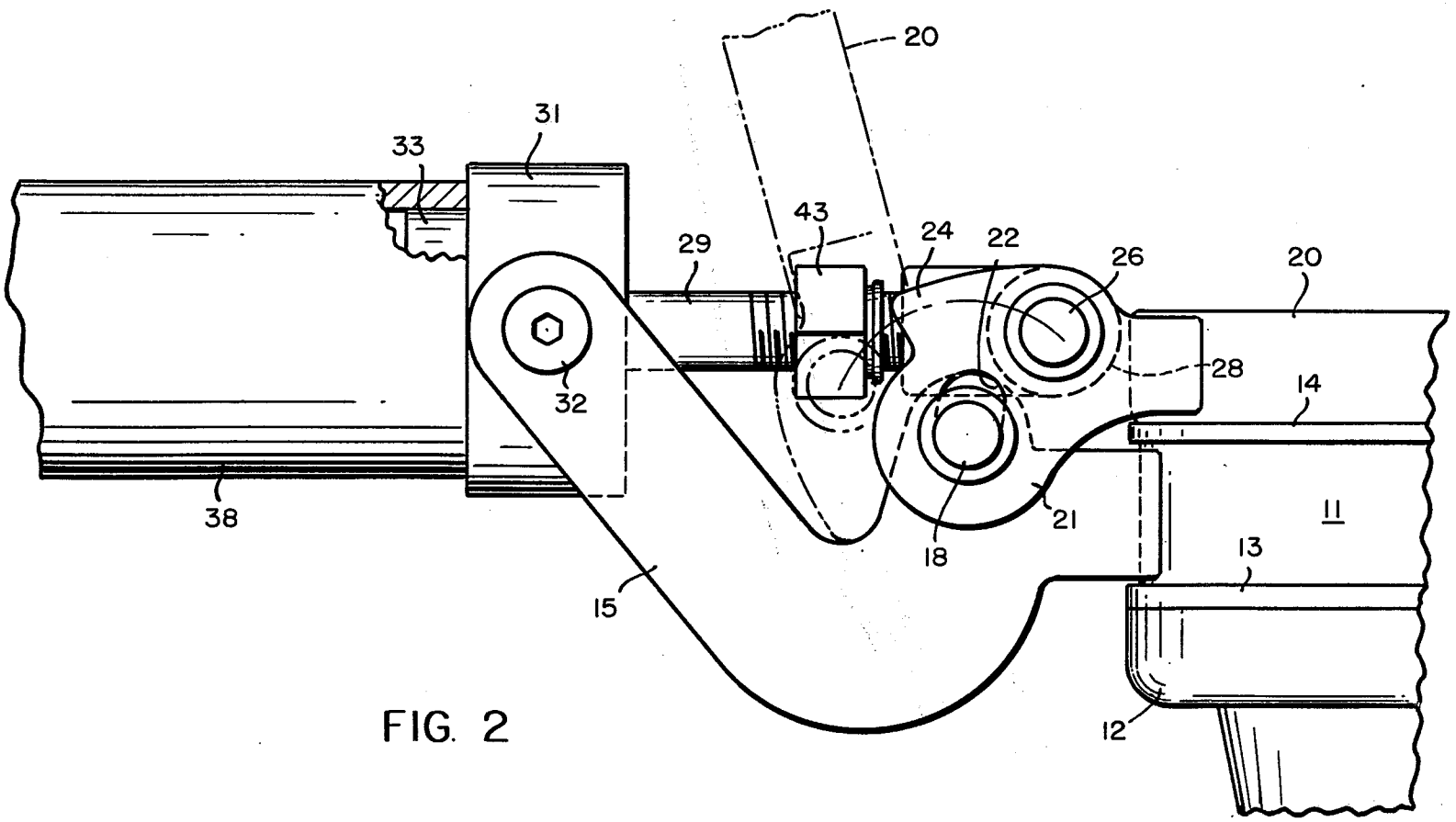
FIG. 2 is a side view of the mechanism.

FIGS. 1 and 2 illustrate an embodiment of this invention mounted on a manhole protection ring 11 attached to a nozzle 12 that defines a manhole opening in a glass lined vessel. The nozzle protection ring 11 is secured to the nozzle by conventional clamps (not shown) that grip the edge of the nozzle and are bolted to the ring. A gasket 13 is provided between the nozzle 12 and ring 11 to insure proper sealing, and a similar gasket 14 is provided between the ring and the manhole cover 20.

The manhole protection ring is preferably covered with a partially crystallized glass-ceramic coating. This type of coating provides adequate chemical resistance, while providing greater resistance to mechanical damage than most chemical resistant glass linings. Alternately, in some instances it may be desirable to make the manhole protection ring of a corrosion resistant metal such as Hastelloy TM or Inconel TM.

Two pivot plates 15 are welded on the protection ring 11. A hinge pin 18 extends through a bore 17 in each of the plates 15, and through slots 22 in hinge lugs 21 welded on the manhole cover 20. The cover 20 pivots about hinge pin 18 as it moves from the closed position, shown in solid in FIG. 1, to the open position shown in phantom. The slots 22 through the hinge lugs are elongated in the vertical direction to insure that the cover can compress the gasket 14 around the entire periphery of the cover.

As is best seen in FIG. 1, backstop dogs 24 extend inwardly from the hinge lugs 21 on the manhole cover. These dogs 24 limit the opening movement of the cover by hitting the pivot plates 15 when the cover reaches the open position shown in the dotted outline in FIG. 2. Preferably, they limit the opening movement of the cover to approximately 15° past vertical, as shown in the Figure. This helps reduce the stresses that can be created in the mounting system by slamming the cover against the backstops, as compared with prior art systems which typically allowed the cover to swing 30° or more past vertical. Preferably, the manhole protection ring is made slightly thicker than normal to help adsorb these stresses. As will be seen in more detail below, this invention provides a shock absorption system that also helps reduce the stresses.

The balancing mechanism is connected to the manhole via a second hinge pin 26 which extends through a second set of bores 27 in the hinge lugs 21 on the cover. Hinge pin 26 extends through a crosshead 28, and a threaded pull rod 29 is screwed into the crosshead 28. The pull rod 29 extends through a yoke 31, mounted on pivot plates 15 by bolts 32, which allow the yoke to pivot to accomodate different positions of the pull rod.

Two sets of disc springs, 34, 35 are mounted on the portion of the pull rod 29 that extends through the yoke 31. A washer 37 and adjusting nut 36 at the end of the pull rod are used to adjust the forces produced by the springs to match the force required to balance the cover as it closes. A cylindrical cover 38, mounted on a pilot 33 on yoke 31, encloses and protects the springs 34, 35 on the end of the pull rod.

When the manhole cover pivots from the open vertical position to the closed position shown in solid in FIG. 1, the crosshead 28 moves away from the yoke 31, thereby pulling rod 29 through the yoke and compressing the disc springs 34, 35 between washer 37 and the end of the yoke. This produces a moment about hinge pin 18 that balances the moment produced by the weight of the cover.

Each of the individual subsets of springs 34, 35 has a regressive or diminishing spring force characteristic. In other words, the incremental change in the force exerted by the springs, for the corresponding incremental compression of the subset, decreases as the springs are compressed. However, by using two subsets of springs, with different spring force characteristics, the overall force characteristic for the system is progressive.

The springs in the subset 34 next to the yoke 31 are larger in diameter but also thicker than the springs in the subset 35 at the far end of the pull rod. Thus, the spring force rate for the first set 34 is greater than the spring force rate for the second set 35 or in other words, subset 34 has a steeper spring force characteristic curve than subset 35.

As the cover 20 starts to move from the vertical position towards the closed position, both subsets of springs will compress, and the force produced on the cover will be a composite of the affects produced by all of the springs. During this initial phase, the spring force rate for the total system is less than the spring force rate for either subset 34 or 35 individually, and is dominated by the weaker subset 35, which makes it slightly regressive.

Since subset 35 is weaker than subset 34, the springs in subset 35 will be completely flattened more rapidly than the springs in subset 34. From this point through the remainder of the travel of the cover, the change in the spring force curve will be directly attributable to subset 34. Thus, the slope of the characteristic curve will be steeper. As a result of this change in slope, the overall spring force characteristic curve, i.e., the spring force characteristic curve over the range encompassed by the vertical position of the cover and the closed position of the cover will be progressive.

By choosing the subsets of springs properly, the overall spring force characteristic curve for the system can be matched closely enough to the forces required to balance the cover so that the cover will remain stationary at any point between the vertical position and the closed position. The frictional forces at the hinge pin 18 allow some latitude in acheiving this match. Because of these frictional forces, the curve of the forces required to balance the cover is a hysteresis curve, with the force required to raise the cover from any angular position always being somewhat higher than the force required to keep the cover from falling from the same position. Thus, the cover will stay at any given angular position if the forces produced by the springs are within this hysteresis curve.

By using two separate stacks of springs 34, 35, as shown in FIG. 1, it is possible to select commercially available springs that can be combined as shown to produce the desired overall spring force curve, despite the fact that the springs in subset 34 are larger in diameter than the springs in subset 35, which would make it difficult if not impossible to combine them in a single set.

Referring again to FIG. 2, two additional disc springs 40 are mounted in a stepped bore 41, at the front end of yoke 31. These springs, which are held in place by an annular retaining ring 42, serve to help absorb the sudden shock which could occur if the cover was rapidly swung open to the dotted position shown in FIG. 1, where the backstop dogs 24 on the manhole cover lugs 21 strike the mounting pivot plates 15. A lock nut 43 mounted on the pull rod 29 engages the disc springs 40 just before the back stop dogs 24 strike the pivot plate 15. The force produced by compression of the springs 40 slows the cover somewhat, absorbing the shock that would otherwise be produced by the rapidly opening of the cover and reducing the stresses in the mounting system.

Thus, it may be seen that this invention produces a number of advantages over previous spring balancers for manhole covers. The overall spring force curve is progressive, which more closely matches the forces required to balance most covers. Also, the system reduces the shock or sudden stresses that can be generated by rapid opening of the cover. Furthermore, since the balancing mechanism is mounted on the manhole protection ring, it can be installed on existing glass lined reactors without drilling welding or similar operations that might damage the lining of the vessel. Of course, those skilled in the art will appreciate that various modifications may be made to the embodiment disclosed above within the scope of this invention, which is defined by the following claims.

I claim:

1. In a balancing aid for a pivotally mounted manhole cover, comprising a stack of conical disc springs and means to compress said stack of springs as said cover pivots from an open vertical position to a closed position, the improvement wherein said stack of springs comprises a first subset of springs having a first diameter and a second subset of springs having a different diameter, with said first subset having a steeper spring force characteristic curve than said second subset, whereby the overall spring force characteristic curve of said combined stack of springs as said cover pivots from the open vertical position to the closed position is progressive.

2. In a balancing aid for a pivotally mounted manhole cover comprising:

a support bracket, said cover being pivotally attached to said support bracket;

a yoke attached to said support bracket;

a rod pivotally attached to said manhole cover and extending through said yoke, whereby said rod moves longitudinally with respect to said yoke as the cover pivots;

a spring surrounding said pull rod and in contact with said yoke, whereby said spring is compressed against said yoke as said cover pivots from an open vertical position to a closed position, and a backstop adapted to arrest movement of said cover at a certain point as said cover pivots from said open vertical position away from said closed position;

the improvement comprising:

at least one compressible member surrounding said pull rod on the opposite side of said yoke from said spring, and means to compress said compressible member against said yoke as the cover nears the point where movement is arrested by said backstop.

3. A balancing aid according to claim 2 wherein said compressible member is a conical disc spring.

4. A mounting system and balancing aid for vessel manhole covers, comprising:

a manhole protection ring adapted to be clamped to a nozzle on a vessel;

at least one support bracket attached to said manhole protection ring, said cover being pivotally attached to said support bracket, a yoke mounted on said support bracket;

a rod adapted to be pivotally mounted on said manhole cover and extending through said yoke, whereby said rod moves longitudinally with respect to said yoke as said cover pivots; and a spring surrounding said rod and in contact with said yoke, whereby said spring is compressed against said yoke as the cover pivots from an open vertical position to a closed position.

5. A mounting system and balancing aid for pivotally mounted manhole covers according to claim 4 further comprising a backstop adapted to arrest movement of said cover at a certain point as said cover pivots from said open vertical position away from said closed position, at least one compressible member surrounding said pull rod on the opposite side of said yoke from said spring, and means to compress said compressible member against said yoke as the cover nears the point where movement is arrested by said backstop.

6. A mounting system and balancing aid for pivotally mounted manhole covers according to claim 5 wherein said compressible member is a conical disc spring.

7. A mounting system and balancing aid according to claim 5 wherein said backstop is adapted to arrest movement of said cover when the cover has pivoted approximately 15° past vertical away from said closed position.

* * * * *

UNITED STATES PATENT AND TRADEMARK OFFICE

CERTIFICATE OF CORRECTION

PATENT NO. : 4,137,669

DATED : February 6, 1979

INVENTOR(S) : Erwin J. Nunlist

It is certified that error appears in the above-identified patent and that said Letters Patent are hereby corrected as shown below:

Column 4, delete the following:

1. In a balancing aid for a pivotally mounted manhole cover, comprising a stack of conical disc springs and means to compress said stack of springs as said cover pivots from an open vertical position to a closed position, the improvement wherein said stack of springs comprises a first subset of springs having a first diameter and a second subset of springs having a different diameter, with said first subset having a steeper spring force characteristic curve than said second subset, whereby the overall spring force characteristic curve of said combined stack of springs as said cover pivots from the open vertical position to the closed position is progressive.

Signed and Sealed this

***Eleventh* Day of *September 1979***

[SEAL]

*Attest:*

LUTRELLE F. PARKER

*Attesting Officer* *Acting Commissioner of Patents and Trademarks*